US009234521B2

(12) United States Patent
Liu

(10) Patent No.: US 9,234,521 B2
(45) Date of Patent: Jan. 12, 2016

(54) RING-TYPE FAN AND IMPELLER STRUCTURE THEREOF

(75) Inventor: Wen-Hao Liu, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 806 days.

(21) Appl. No.: 13/481,879

(22) Filed: May 28, 2012

(65) Prior Publication Data

US 2013/0315723 A1 Nov. 28, 2013

(51) Int. Cl.

| | |
|---|---|
| ***F04D 25/06*** | (2006.01) |
| ***F04D 29/16*** | (2006.01) |
| ***F04D 29/32*** | (2006.01) |

(52) U.S. Cl.

CPC ..... *F04D 25/0613* (2013.01); *F04D 29/164* (2013.01); *F04D 29/326* (2013.01)

(58) Field of Classification Search

CPC .. F04D 25/0613; F04D 29/164; F04D 29/326

USPC ..... 415/220, 182.1; 416/182, 194, 195; 361/695, 678

See application file for complete search history.

(56) References Cited

U.S. PATENT DOCUMENTS

| | | | | |
|---|---|---|---|---|
| 5,423,660 | A * | 6/1995 | Sortor | 416/189 |
| 6,027,307 | A * | 2/2000 | Cho et al. | 415/173.5 |
| 6,508,624 | B2 * | 1/2003 | Nadeau et al. | 415/173.3 |
| 7,004,732 | B2 * | 2/2006 | Cho et al. | 417/423.15 |
| 7,025,570 | B2 * | 4/2006 | Jung et al. | 416/192 |
| 7,114,921 | B2 * | 10/2006 | Iwasaki | F04D 29/326 415/173.6 |
| 7,632,063 | B2 * | 12/2009 | Takeuchi et al. | 415/119 |
| 7,762,769 | B2 * | 7/2010 | Stevens et al. | 415/220 |
| 2004/0123482 | A1 * | 7/2004 | Tokuda et al. | 34/90 |
| 2007/0160468 | A1 * | 7/2007 | Tsubota | 415/173.6 |

* cited by examiner

*Primary Examiner* — Christopher Verdier
*Assistant Examiner* — Aaron R Eastman
(74) *Attorney, Agent, or Firm* — C. G. Mersereau; Nikolai & Mersereau, P.A.

(57) ABSTRACT

A ring-type fan includes a frame having a receiving space defined between an air inlet and an air outlet thereof and being provided along an inner side of the air outlet with an inward projected wall portion; an impeller assembly rotatably mounted in the receiving space and including spaced impellers outward extended from a hub, and a ring member connected to radially outer ends of the impellers and externally provided with a circle of stop section, which and the projected wall portion together define an air passage between them; and at least one pressure relief section defining an airflow guide on the frame to communicate with the receiving space and the air passage. Any backflow can be guided out of the frame via the air passage and the pressure relief section without interfering with the inflow of air, allowing the ring-type fan to have upgraded heat dissipation performance.

7 Claims, 7 Drawing Sheets

RING-TYPE FAN AND IMPELLER STRUCTURE THEREOF

FIELD OF THE INVENTION

The present invention relates to a ring-type fan and an impeller structure thereof, and more particularly to a ring-type fan and an impeller structure thereof that can reduce the negative pressure at an air outlet of the fan caused by backflows of air and can therefore enable the ring-type fan to have upgraded heat dissipation performance.

BACKGROUND OF THE INVENTION

Following the quick technical development in the electronic industrial fields, various types of chips, such as the central processing unit (CPU), now have highly increased density of transistors provided thereon. While the currently available electronic devices have faster and faster data processing speed, they also consume more power and produce more heat during operation. The produced high amount of heat must be timely removed from the electronic devices, lest the raised temperature should cause burnout of the CPU and other electronic elements to adversely influence the whole system safety and performance. For the CPU to work stably, the electronic devices must be provided with better and more efficient heat dissipation devices to remove the heat produced by the CPU during operation thereof.

A conventional ring-type fan includes a frame and an impeller assembly. The frame has an air inlet and an air outlet, and a receiving space is defined in the frame between the air inlet and the air outlet. The frame also has a forward extended shaft seat located at a central area of the receiving space, and the impeller assembly is rotatably mounted in the receiving space and connected to the shaft seat.

The impeller assembly includes a hub, a plurality of impellers outward extended from and spaced around the hub, and a ring member connected to radially outer ends of the impellers. When the impeller assembly is mounted in the receiving space, a clearance is formed between the ring member and an inner wall surface of the frame. When the ring-type fan operates, external air flows into the receiving space via the air inlet and flows out of the frame via the air outlet. At this point, negative pressure will be produced at the air outlet, and part of the outflow of air forms backflows. The backflows pass through the clearance between the ring member and the frame to interfere with inflow of air and cause unsmooth flowing of outflow of air, resulting in lowered heat dissipation efficiency and performance of the ring-type fan and reduced service life thereof.

Accordingly, the prior art ring-type fan has the following disadvantages: (1) lowered heat dissipation efficiency; and (2) reduced fan performance.

It is therefore tried by the inventor to develop an improved impeller structure and ring-type fan using same, so as to overcome the problems in the prior art ring-type fan.

SUMMARY OF THE INVENTION

A primary object of the present invention is to provide an impeller structure for ring-type fan that is able to minimize the forming of negative pressure at an air outlet of the fan, so that the ring-type fan can have upgraded heat dissipation performance.

Another object of the present invention is to provide an impeller structure for ring-type fan that also helps in removing heat from surrounding electronic elements.

A further object of the present invention is to provide a ring-type fan that is able to minimize the forming of negative pressure at an air outlet thereof, so that the ring-type fan can have upgraded heat dissipation performance.

A still further object of the present invention is to provide a ring-type fan that also helps in removing heat from surrounding electronic elements.

To achieve the above and other objects, the impeller structure for ring-type fan according to the present invention includes an impeller assembly having a hub, a plurality of impellers outward extended from and spaced around the hub, and a ring member connected to radially outer ends of the impellers and having a stop section formed around an outer side thereof. When a ring-type fan using the impeller structure of the present invention operates, air flows through the impeller structure from a front side to a rear side thereof. Any backflow of the air flowed through the impeller structure would be stopped by the stop section from interfering with the inflow of air. In this manner, it is possible to minimize the forming of negative pressure at the rear side of the impeller structure and thereby increase the heat dissipation performance of the ring-type fan.

To achieve the above and other objects, the ring-type fan according to the present invention includes a frame, an impeller assembly, and at least one pressure relief section. The frame has an air inlet and an opposite air outlet, and internally defines a receiving space between the air inlet and the air outlet; and the frame is provided along an inner side of the air outlet with at least one inward projected wall portion. The impeller assembly is rotatably received in the receiving space and connected to the frame, and includes a hub, a plurality of impellers outward extended from and spaced around the hub and a ring member connected to radially outer ends of the impellers. The ring member is provided around a rear outer circumferential edge with a stop section corresponding to the projected wall portion on the frame, such that the stop section and the projected wall portion together define an air passage between them. The pressure relief section is provided on and sidewardly extends through the frame to define an airflow guide thereat to communicate with the receiving space and the air passage.

With the above arrangements, when the ring-type fan of the present invention operates, air outside the frame is sucked into the receiving space via the air inlet and then flows out of the frame 20 via the air outlet. At this point, a part of the air will form backflows at the air outlet. The backflows will sequentially pass the air passage and the airflow guides to finally flow to an outer side of the frame without interfering the inflow of air. In this manner, it is possible to minimize the forming of negative pressure at the air outlet of the ring-type fan and thereby increase the heat dissipation performance of the ring-type fan.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
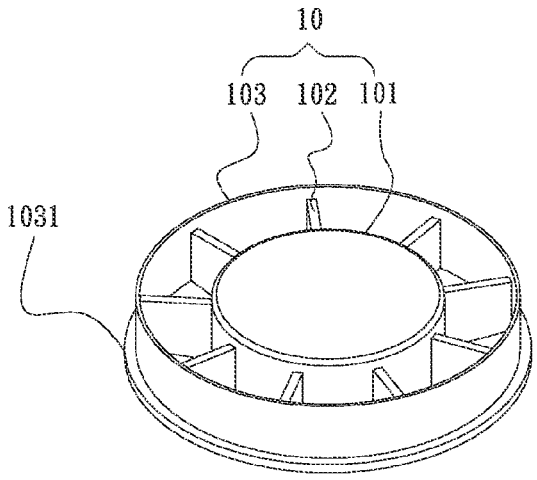
FIG. 1 is a perspective view of a first embodiment of an impeller structure for ring-type fan according to the present invention.

The present invention will now be described with some preferred embodiments thereof and with reference to the accompanying drawings. For the purpose of easy to understand, elements that are the same in the preferred embodiments are denoted by the same reference numerals.

Please refer to FIG. 1 that is a perspective view of a first embodiment of an impeller structure for ring-type fan according to the present invention. As shown, the impeller structure for ring-type fan in the first embodiment thereof includes an impeller assembly 10 formed from a hub 101, a plurality of impellers 102 outward extended from and spaced around the hub 101, and a ring member 103 connected to radially outer ends of the impellers 102. The ring member 103 is formed around a rear outer circumferential edge with a stop section 1031. When a ring-type fan using the above-structured impeller structure operates, air flows through the impeller structure from a front side to a rear side thereof. Backflows of the air flowed to the rear side of the impeller structure would be stopped by the stop section 1031 from interfering with the inflow of air. In this manner, it is possible to minimize the forming of negative pressure at the rear side of the impeller structure and thereby increase the heat dissipation performance of the ring-type fan.

Figure 2:
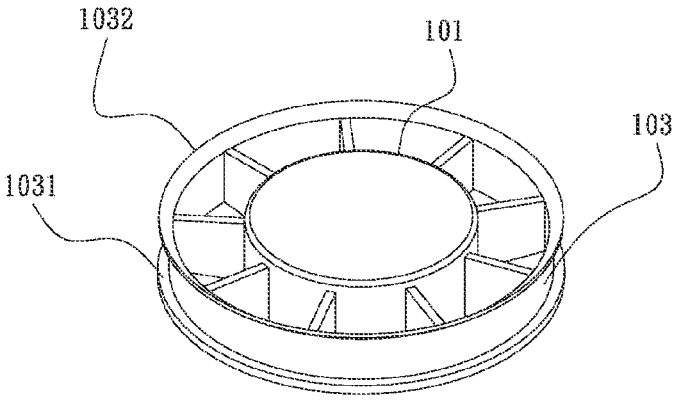
FIG. 2 is a perspective view of a second embodiment of the impeller structure for ring-type fan according to the present invention.

FIG. 2 is a perspective view of a second embodiment of the impeller structure for ring-type fan according to the present invention. As shown, the impeller structure for ring-type fan in the second embodiment is generally structurally similar to the first embodiment, except that the ring member 103 is further provided around a front outer circumferential edge with a flared flange 1032, which radially outward extends opposite to the hub 101. The flared flange 1032 also functions to stop backflows from interfering with the inflow of air, and accordingly helps the ring-type fan with the impeller structure of the present invention to have upgraded heat dissipation performance.

Figure 3A:
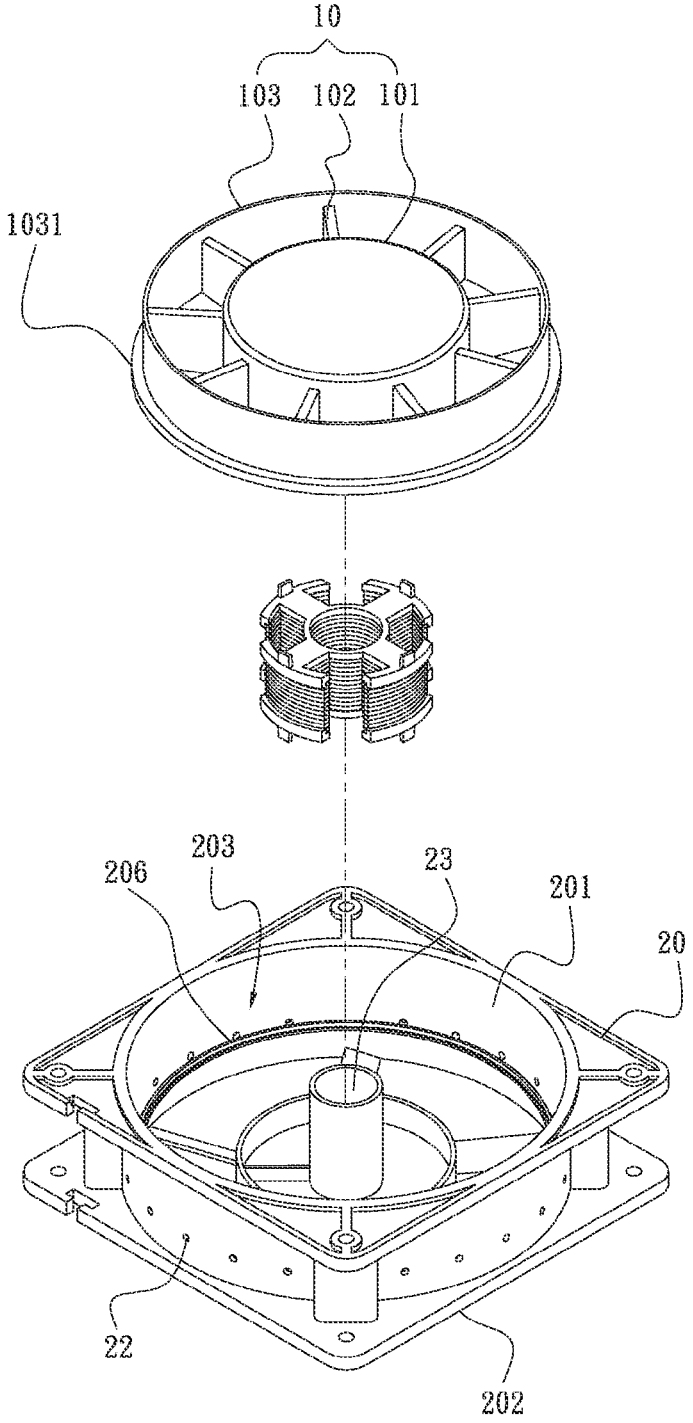
FIG. 3A is an exploded perspective view of a first embodiment of a ring-type fan according to the present invention.
Figure 3B:
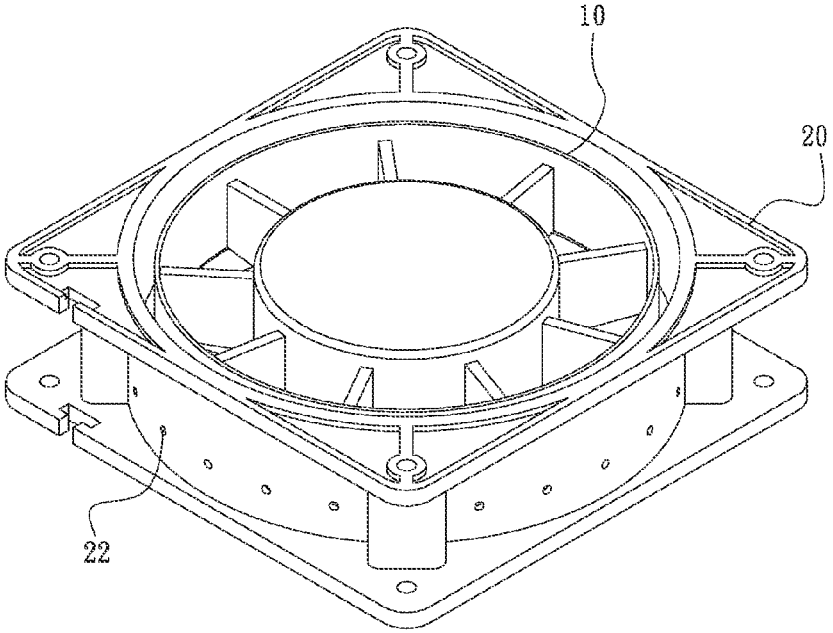
FIG. 3B is an assembled view of FIG. 3A.
Figure 3C:
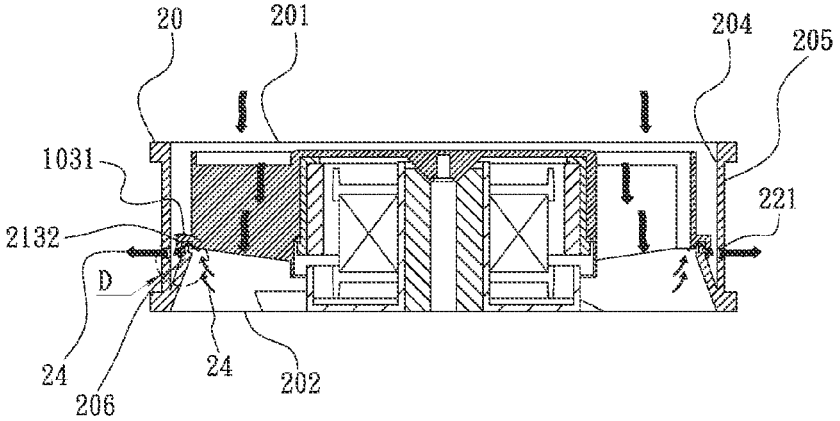
FIG. 3C is a sectional side view of FIG. 3B.

Please refer to FIGS. 3A and 3B that are exploded and assembled perspective views, respectively, of a first embodiment of a ring-type fan according to the present invention, and to FIG. 3C that is an assembled sectional side view of FIG. 3B. As shown, the ring-type fan in the first embodiment thereof includes a frame 20 and an impeller assembly 10. The frame 20 has an air inlet 201 and an air outlet 202, and has at least one pressure relief section 22 provided on a peripheral wall thereof. The frame 20 internally defines a receiving space 203 between the air inlet 201 and the air outlet 202. Further, the frame 20 is provided along an inner side of the air outlet 202 with at least one inward projected wall portion 206. The impeller assembly 10 is rotatably mounted in the receiving space 203 and connected to the frame 20. The impeller assembly 10 includes a hub 101, a plurality of impellers 102 outward extended from and spaced around the hub 101, and a ring member 103 connected to radially outer ends of the impellers 102. The ring member 103 is formed around a rear outer circumferential edge with a stop section 1031 corresponding to the projected wall portion 206 on the frame 20, such that the stop section 1031 and the projected wall portion 206 together define an air passage 2132 between them. The pressure relief section 22 extends through the peripheral wall of the frame 20 and defines an airflow guide 221 thereat, which communicates with the receiving space 203 and the air passage 2132. The pressure relief section 22 may be a round hole as shown in FIG. 3B, or a slot in any geometric shape as shown in FIG. 3E. Further, in the case of having a plurality of pressure relief sections 22, the holes or the slots may be equally spaced or irregularly spaced (not shown) along the frame 20.

The peripheral wall of the frame 20 has an inner wall surface 204 and an opposite outer wall surface 205. The airflow guide 221 extends from the inner wall surface 204 to the outer wall surface 205 and communicates with the receiving space 203. The frame 20 further includes a forward extended shaft seat 23 located at a central area of the receiving space 203, and the impeller assembly 10 is rotatably mounted to the shaft seat 23.

Figure 3D:
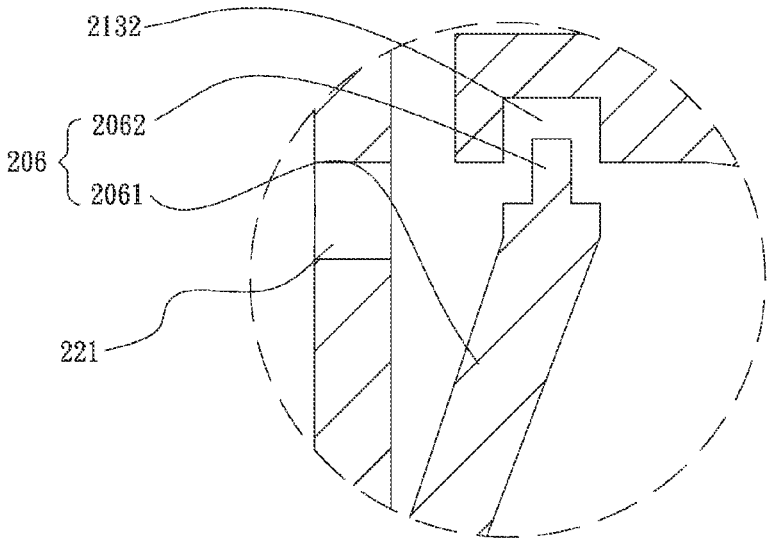
FIG. 3D is an enlarged view of the circled area D of FIG. 3C.
Figure 3E:
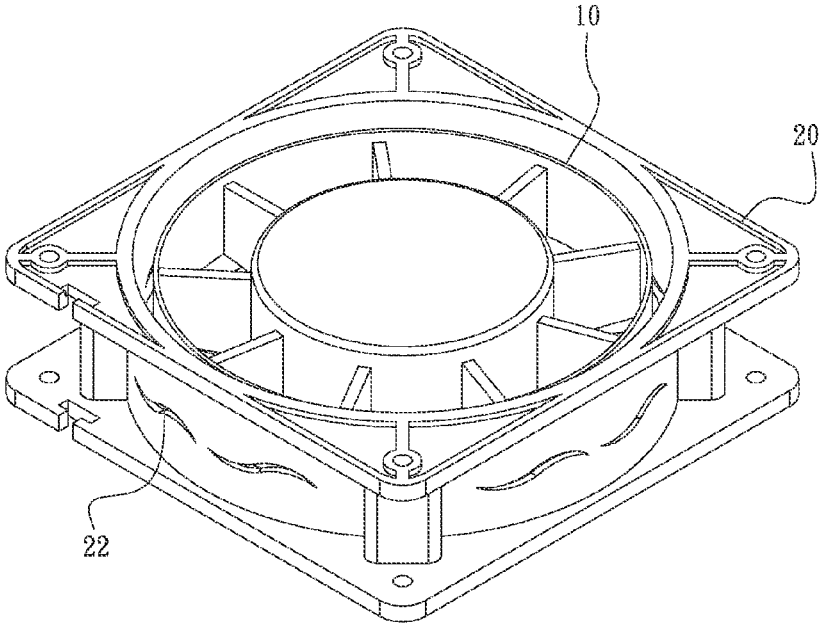
FIG. 3E is an assembled perspective view of a variant of the ring-type fan of FIG. 3B.

FIG. 3D is an enlarged view of the circled area D of FIG. 3C. Please refer to FIGS. 3C and 3D at the same time. The projected wall portion 206 in the air outlet 202 of the frame 20 includes a first projected section 2061 and a second projected section 2062. The first projected section 2061 is obliquely projected from the inner side of the air outlet 202 toward the air inlet 201 of the frame 20, and the second projected section 2062 is integrally formed with and forwardly extended from a front end of the first projected section 2061. The above-mentioned air passage 2132 is defined by and between the second projected section 2062 and the stop section 1031.

When the ring-type fan operates, air outside the frame 20 is first sucked into the receiving space 203 via the air inlet 201 and then flows through the receiving space 203 to the air outlet 202. While the air is flowing out of the frame 20 via the air outlet 202, a part of the air will form backflows 24. The backflows 24 will first pass the air passage 2132 defined between the stop section 1031 and the projected wall portion 206, and then pass through the airflow guides 221 defined by the pressure relief sections 22 on the frame 20 to finally flow to an outer side of the frame 20. In this manner, the backflows 24 would not interfere with the inflow of air at the air inlet 201 and the remaining air in the receiving space 203 can more smoothly flow out of the frame 20 via the air outlet 202, enabling the ring-type fan to have upgraded heat dissipation performance. In addition, the backflows 24 passed through the airflow guides 221 to the outer side of the frame 20 also help in removing heat from other electronic elements surrounding the ring-type fan.

Figure 4:
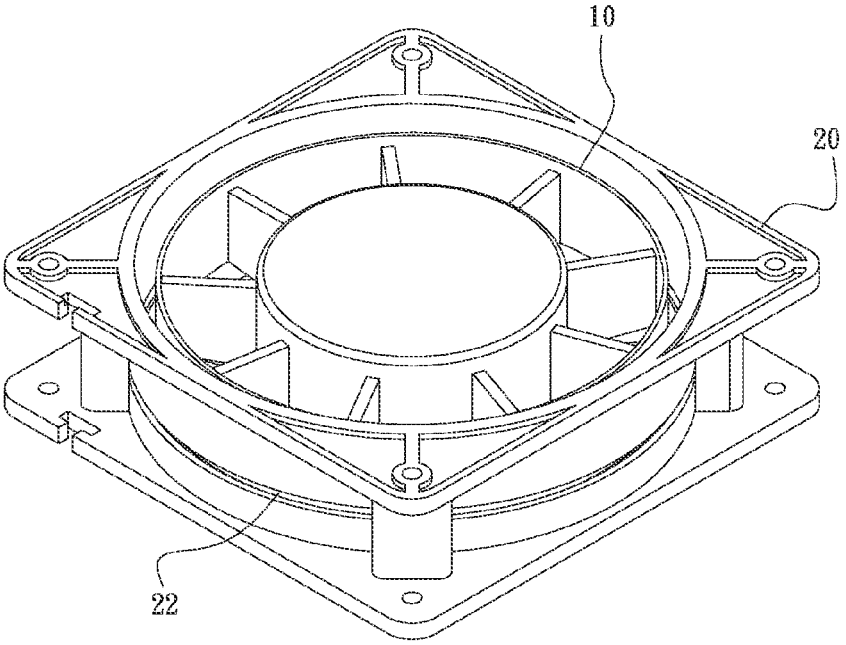
FIG. 4 is an assembled perspective view of a second embodiment of the ring-type fan according to the present invention.

FIG. 4 is an assembled perspective view of a second embodiment of the ring-type fan according to the present invention. As shown, the ring-type fan in the second embodiment thereof is generally structurally similar to the first embodiment, except that the pressure relief section 22 is in the form of an elongated slot extending around the peripheral wall of the frame 20. Please refer to FIGS. 4 and 3C at the same time. When the ring-type fan operates, air outside the frame 20 is first sucked into the receiving space 203 via the air inlet 201 and then flows through the receiving space 203 to the air outlet 202. While the air is flowing out of the frame 20 via the air outlet 202, a part of the air will form backflows 24. The backflows 24 will first pass the air passage 2132 defined between the stop section 1031 and the projected wall portion 206, and then pass through the airflow guides 221 defined by the pressure relief sections 22 on the frame 20 to finally flow to an outer side of the frame 20. In this manner, the backflows 24 would not interfere with the inflow of air at the air inlet 201 and the remaining air in the receiving space 203 can more smoothly flow out of the frame 20 via the air outlet 202, enabling the ring-type fan to have upgraded heat dissipation performance.

Figure 5:
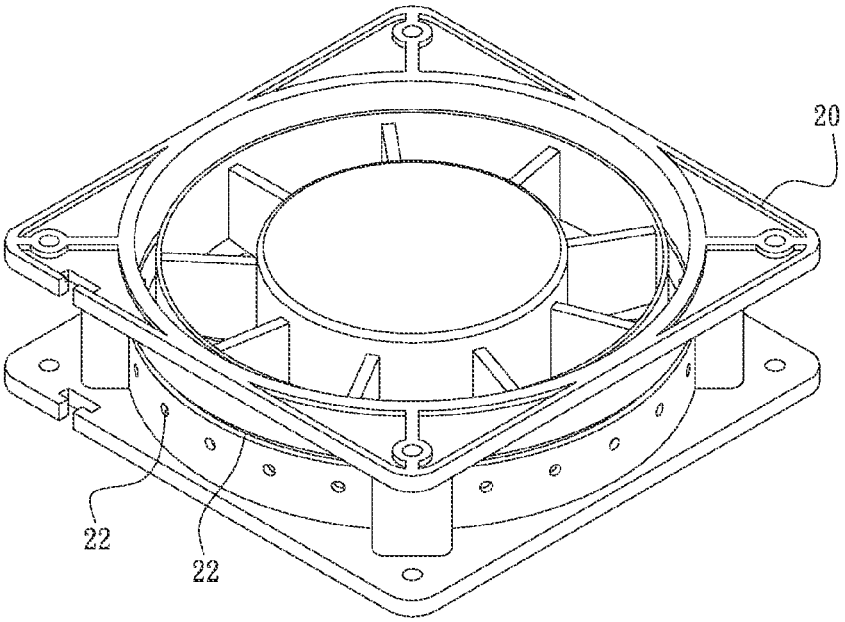
FIG. 5 is an assembled perspective view of a third embodiment of the ring-type fan according to the present invention.

FIG. 5 is an assembled perspective view of a third embodiment of the ring-type fan according to the present invention. As shown, the ring-type fan in the third embodiment thereof is generally structurally similar to the previous embodiments; except that it has pressure relief sections 22 including both an elongated slot and a plurality of holes extending along and spaced around the peripheral wall of the frame 20, respectively. Please refer to FIGS. 5 and 3C at the same time. When the ring-type fan operates, air outside the frame 20 is first sucked into the receiving space 203 via the air inlet 201 and then flows through the receiving space 203 to the air outlet 202. While the air is flowing out of the frame 20 via the air outlet 202, a part of the air will form backflows 24. The backflows 24 will first pass the air passage 2132 defined between the stop section 1031 and the projected wall portion 206, and then pass through the airflow guides 221 defined by the pressure relief sections 22 on the frame 20 to finally flow to an outer side of the frame 20. In this manner, the backflows 24 would not interfere with the inflow of air at the air inlet 201 and the remaining air in the receiving space 203 can more smoothly flow out of the frame 20 via the air outlet 202, enabling the ring-type fan to have upgraded heat dissipation performance.

Figure 6A:
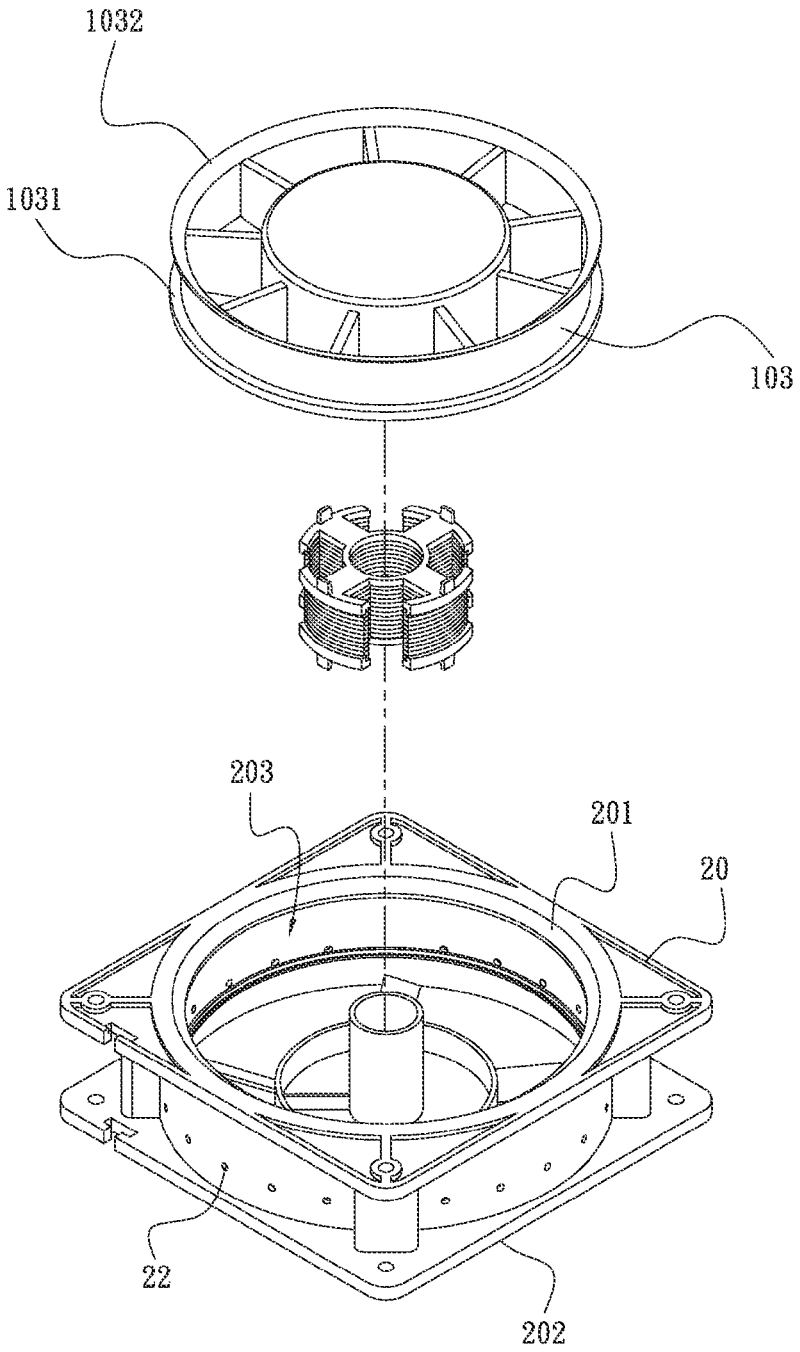
FIG. 6A is an exploded perspective view of a fourth embodiment of the ring-type fan according to the present invention.
Figure 6B:
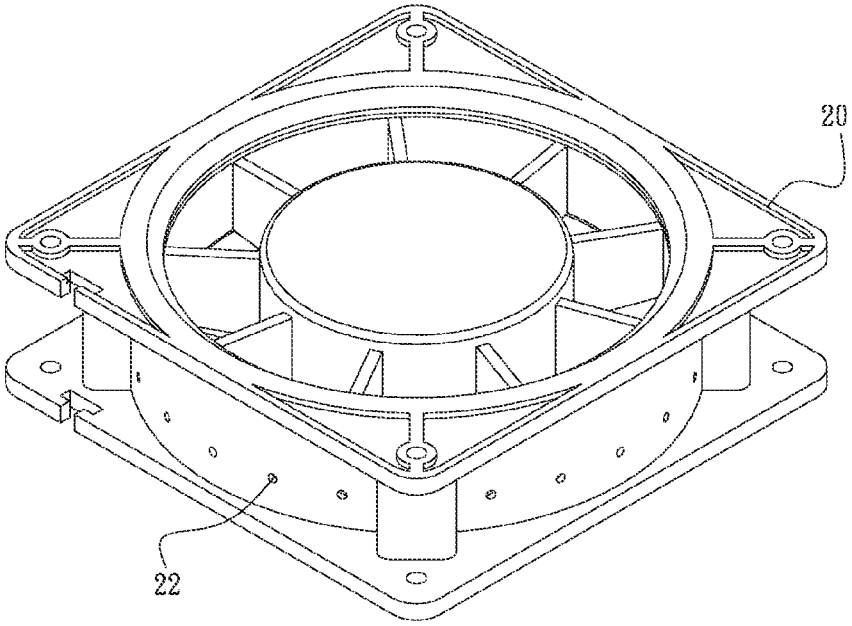
FIG. 6B is an assembled view of FIG. 6A.
Figure 6C:
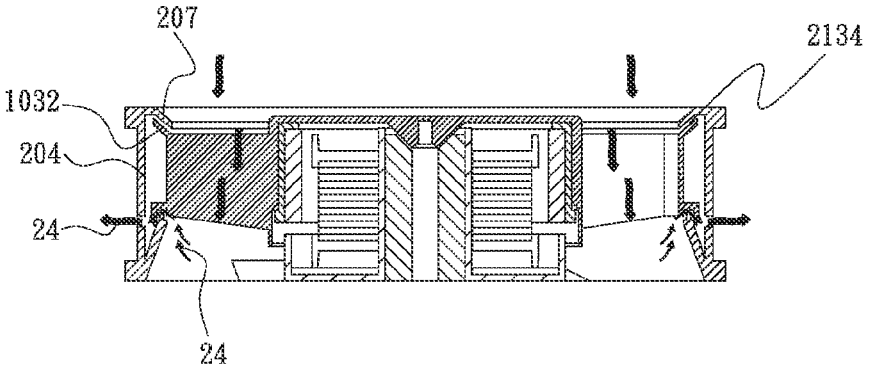
FIG. 6C is a sectional side view of FIG. 6B.

Please refer to FIGS. 6A and 6B that are exploded and assembled perspective views, respectively, of a fourth embodiment of the ring-type fan according to the present invention, and to FIG. 6C that is an assembled sectional side view of FIG. 6B. As shown, the ring-type fan in the fourth embodiment thereof is generally structurally similar to the previous embodiments; except that the frame 20 in the fourth embodiment is further provided around an inner side of the air inlet 201 with an inclined flange portion 207 radially inwardly extended toward a central area of the receiving space 203, and that the ring member 103 of the impeller assembly 10 further has a flared flange 1032 provided around a front outer circumferential edge corresponding to the inclined flange portion 207 and radially outward extended toward the inner wall surface 204 of the frame 20, so that a clearance 2134 is formed between the flared flange 1032 and the inclined flange portion 207 when the impeller assembly 10 is mounted in the receiving space 203. When the ring-type fan operates, air outside the frame 20 is first sucked into the receiving space 203 via the air inlet 201 and then flows through the receiving space 203 to the air outlet 202. While the air is flowing out of the frame 20 via the air outlet 202, a part of the air will form backflows 24. The backflows 24 will sequentially pass through the air passage 2132 and the airflow guides 221 to finally flow to an outer side of the frame 20. In the case there are still small parts of the backflows 24 flowing toward the air inlet 201, these small parts of the backflows 24 would be stopped by the inclined flange portion 207 of the frame 20 and the flared flange 1032 of the ring member 203 to thereby flow backward and out of the frame 20 via the airflow guides 221 defined by the pressure relief sections 22. In this manner, it is able to more effectively prevent the backflows 24 from interfering with the inflow of air at the air inlet 201, enabling the ring-type fan to have even upgraded heat dissipation performance.

Accordingly, the present invention is superior to the conventional ring-type fans for the following advantages: (1) providing increased heat dissipation efficiency; and (2) giving the ring-type fan upgraded performance.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A ring-type fan, comprising:

a frame having an air inlet and an opposite air outlet, and internally defining a receiving space between the air inlet and the air outlet; the frame being provided along an inner side of the air outlet with at least one inward projected wall portion; the projected wall portion including a first projected section and a second projected section; the first projected section being obliquely projected from the inner side of the air outlet toward the air inlet of the frame; and the second projected section being integrally formed with and forwardly extended from a front end of the first projected section;

an impeller assembly being rotatably mounted in the receiving space and connected to the frame; the impeller assembly including a hub, a plurality of impellers outward extended from and spaced around the hub, and a ring member connected to radially outer ends of the impellers; the ring member having a top edge corresponding to the air inlet and a bottom edge corresponding to the air outlet; the top edge and the bottom edge being respectively provided with a flared flange and a stop section, wherein the stop section accommodates the second projected section such that together they define an air passage between them; and at least one pressure relief section provided on and extended through a peripheral wall of the frame to define an airflow guide thereat, and the airflow guide communicating with the receiving space and the air passage;

wherein the frame is further provided around an inner side of the air inlet with an inclined flange portion, located radially inside the flared flange, which radially inwardly extends toward a central area of the receiving space; and a clearance is formed between the flared flange and the inclined flange portion.

2. The ring-type fan as claimed in claim 1, wherein the pressure relief section is selected from the group consisting of a hole and a long slot.

3. The ring-type fan as claimed in claim 1, wherein the peripheral wall of the frame has an inner wall surface and an opposite outer wall surface, the airflow guide being extended from the outer wall surface to the inner wall surface to communicate with the receiving space.

4. The ring-type fan as claimed in claim 1, wherein there is a plurality of pressure relief sections formed around the peripheral wall of the frame to equally space from one another.

5. The ring-type fan as claimed in claim 1, wherein there is a plurality of pressure relief sections formed around the peripheral wall of the frame to irregularly space from one another.

6. The ring-type fan as claimed in claim 1, wherein the pressure relief section has a configuration selected from the group consisting of a round hole, an opening of any geometrical shape, and an elongated slot.

7. The ring-type fan as claimed in claim 1, wherein the frame further includes a forward extended shaft seat located at a central area of the receiving space, and the impeller assembly being rotatably mounted to the shaft seat.

* * * * *